US009201347B2

(12) United States Patent
Wada et al.

(10) Patent No.: US 9,201,347 B2
(45) Date of Patent: Dec. 1, 2015

(54) DEVELOPING DEVICE INCLUDING A RESTRICTING MEMBER HAVING A RESTRICTING BASE FORMED OF RESIN AND A METAL FOIL ARRANGED AT A TIP PART OF THE RESTRICTING BASE, AND IMAGE FORMING APPARATUS THEREWITH

(71) Applicant: KYOCERA Document Solutions Inc., Osaka (JP)

(72) Inventors: Minoru Wada, Osaka (JP); Masaru Hatano, Osaka (JP); Yoshinori Horiuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/593,595

(22) Filed: Jan. 9, 2015

(65) Prior Publication Data

US 2015/0198911 A1 Jul. 16, 2015

(30) Foreign Application Priority Data

Jan. 15, 2014 (JP) ..... 2014-004917

(51) Int. Cl.
*G03G 15/09* (2006.01)
*G03G 15/08* (2006.01)

(52) U.S. Cl.
CPC ..... *G03G 15/0891* (2013.01); *G03G 15/0812* (2013.01)

(58) Field of Classification Search
CPC ..... G03G 15/0812
See application file for complete search history.

(56) References Cited

U.S. PATENT DOCUMENTS 4,780,741 A * 10/1988 Wada ..... G03G 15/0812 399/274
2006/0233572 A1* 10/2006 Ogawa ..... G03G 15/0921 399/270

FOREIGN PATENT DOCUMENTS

JP 3-103870 A 4/1991

* cited by examiner

*Primary Examiner* — Clayton E Laballe
*Assistant Examiner* — Victor Verbitsky
(74) *Attorney, Agent, or Firm* — Stein IP, LLC

(57) ABSTRACT

A developing device has a developing container, a developer carrier, and a restricting member. The restricting member restricts the layer thickness of developer on the surface of the developer carrier. The restricting member includes a restricting base formed of resin with higher strength than the developing container and a metal foil arranged at a tip part of the restricting base. The metal foil has a downstream face portion fixed to a downstream-side face of the restricting base and a restricting face portion formed by bending the tip of the downstream face portion to an upstream side and arranged to face the developer carrier.

5 Claims, 5 Drawing Sheets

DEVELOPING DEVICE INCLUDING A RESTRICTING MEMBER HAVING A RESTRICTING BASE FORMED OF RESIN AND A METAL FOIL ARRANGED AT A TIP PART OF THE RESTRICTING BASE, AND IMAGE FORMING APPARATUS THEREWITH

INCORPORATION BY REFERENCE

This application is based upon and claims the benefit of priority from the corresponding Japanese Patent Application No. 2014-004917 filed on Jan. 15, 2014, the entire contents of which are incorporated herein by reference.

BACKGROUND OF THE INVENTION

The present disclosure relates to a developing device, and to an image forming apparatus provided therewith. More particularly, the present disclosure relates to a developing device including a restricting member for restricting the layer thickness of developer on the surface of a developer carrier, and to an image forming apparatus provided therewith.

Conventionally, there are known, as developing devices for developing an electrostatic latent image on a photosensitive member as an image carrier, those adopting a one-component developing method and those adopting a two-component developing method. The two-component developing method, which uses developer containing toner and magnetic carrier, offers a stable amount of electrostatic charge for a long period and is thus suitable to aim at an extended lifetime. For example, a developing device adopting the two-component developing method accommodates developer containing toner and magnetic carrier, and feeds the developer from a stirring member to a developing roller (developer carrier). The developing roller incorporates a magnet, which carries the developer in the form of a magnetic brush on the surface of the developing roller. As the developing roller rotates, the developer is transported toward the photosensitive member. Out of the developer carried on the developing roller, only the toner is fed to the photosensitive member, and the electrostatic latent image on the photosensitive member is made visible as a toner image.

A developing device as described above is provided with a restricting member for restricting the layer thickness of developer in order to make constant the amount of developer transported, as the developing roller rotates, toward the photosensitive member.

There is also known a developing device comprising a resin-made developing container for storing developer, a stir-transport member for stirring and transporting the developer, a developing roller fed with the developer from the stir-transport member, and a restricting member for restricting the layer thickness of developer on the surface of the developing roller, wherein the restricting member is composed of a restricting base formed integrally with the developing container and a metal member covering a tip part of the restricting base. With this developing device, owing to the use of the metal member in the tip part of the restricting member, it is possible to form the tip part of the restricting member with high accuracy, and to suppress wear in the tip part of the restricting member.

SUMMARY OF THE INVENTION

According to one aspect of the present disclosure, a developing device is provided with a developing container, a stir-transport member, a developer carrier, and a restricting member. The developing container stores developer containing carrier and toner. The stir-transport member stirs and transports the developer inside the developing container. The developer carrier carries the developer fed from the stir-transport member. The restricting member is arranged to face the developer carrier, and restricts the layer thickness of developer on the surface of the developer carrier. The restricting member includes a restricting base formed of resin with higher strength than the developing container, and a metal foil arranged at a tip part of the restricting base. The metal foil has a downstream face portion fixed to the downstream-side face of the restricting base with respect to the rotation direction of the developer carrier, and a restricting face portion formed by bending the tip of the downstream face portion to the upstream side with respect to the rotation direction of the developer carrier and arranged to face the developer carrier.

Further features and advantages of the present disclosure will become apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Hereinafter, embodiments of the present disclosure will be described with reference to the accompanying drawings.

(First Embodiment)

Figure 1:
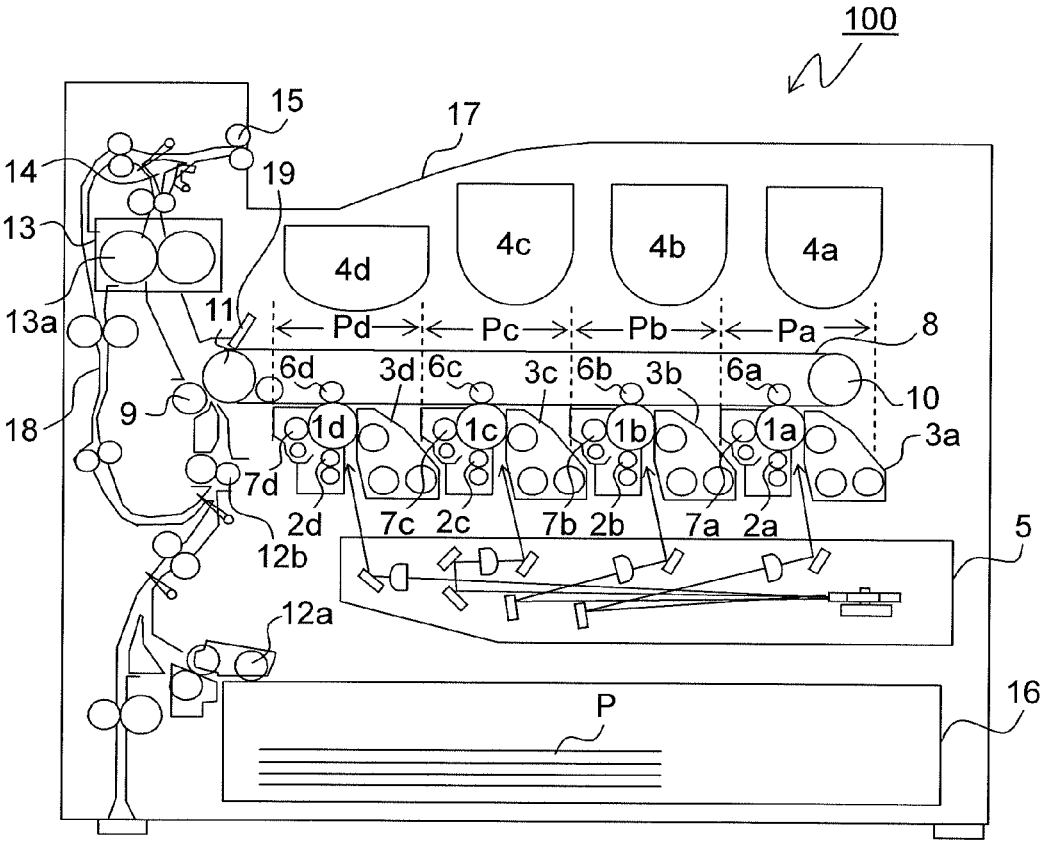
FIG. 1 is a sectional view schematically showing the construction of an image forming apparatus provided with a developing device according to a first embodiment of the present disclosure.
Figure 2:
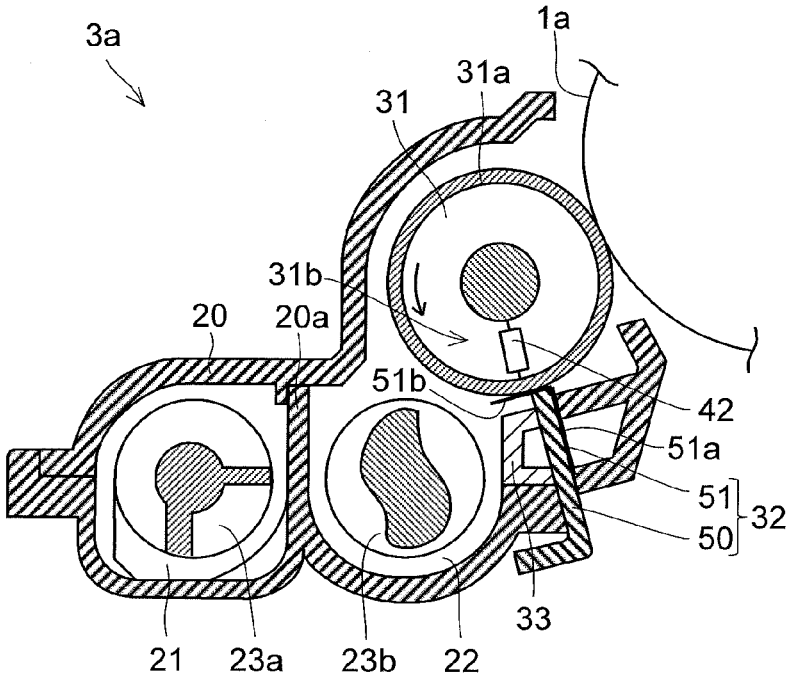
FIG. 2 is a side sectional view showing the structure of a developing device according to the first embodiment of the present disclosure.
Figure 3:
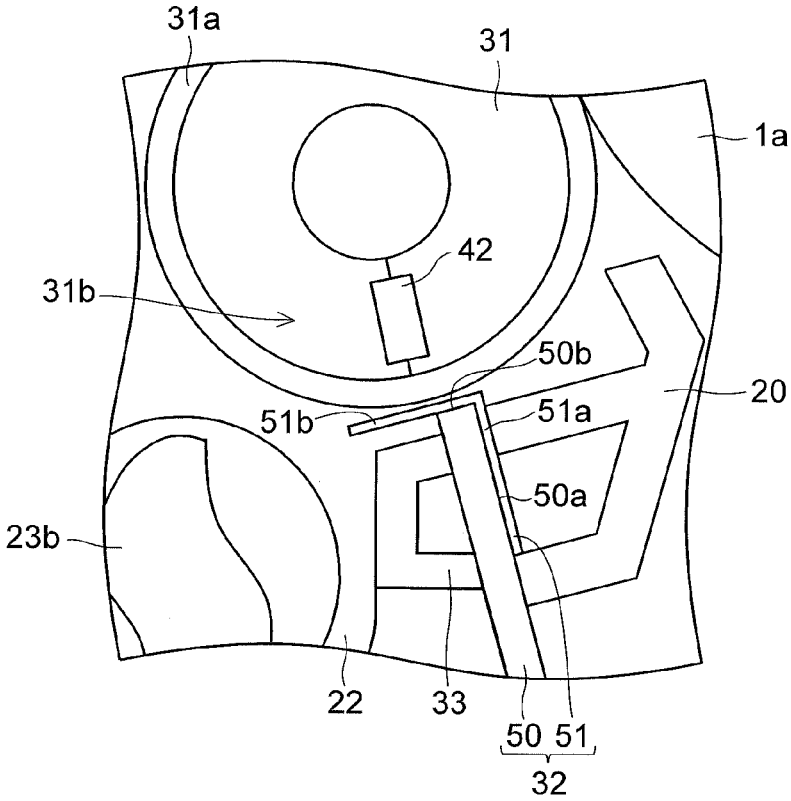
FIG. 3 is an enlarged sectional view showing the structure of and around an ear-breaking blade in a developing device according to the first embodiment of the present disclosure.

With reference to FIGS. 1 to 3, the construction of an image forming apparatus 100 provided with developing devices 3*a* to 3*d* according to a first embodiment of the present disclosure will be described. The image forming apparatus 100 (here, a color printer) has, inside its body, four image formation sections Pa, Pb, Pc, and Pd arranged in this order from the upstream side (in FIG. 1, the right side) with respect to the direction of transport of toner by an intermediary transfer belt 8. These image formation sections Pa to Pd are provided to correspond to different colors (cyan, magenta, yellow, and black), and respectively form a cyan, a magenta, a yellow, and a black image sequentially through processes of static charging, exposure, development, and transfer.

In the image formation sections Pa to Pd, there are respectively arranged photosensitive drums (image carriers) 1*a*, 1*b*, 1*c*, and 1*d* which carry visible images (toner images) of different colors, and beside these photosensitive drums 1*a* to 1*d*, there is arranged an intermediary transfer belt 8 which rotates clockwise in FIG. 1 by being driven by a driving means (unillustrated). As the intermediary transfer belt 8 moves while keeping in contact with the photosensitive drums 1*a* to 1*d*, the toner images formed on the photosensitive drums 1*a* to 1*d* are primarily transferred to the intermediary transfer belt 8 and are superimposed on one another. Thereafter, the toner images primarily transferred to the intermediary transfer belt 8 are secondarily transferred to transfer paper P, as an example of a recording medium, by the action of a secondary transfer roller 9. Then, the transfer paper P having the toner images secondarily transferred to it has those toner images fused to it in a fusing section 13, and is then discharged out of the body of the image forming apparatus 100. While the photosensitive drums 1*a* to 1*d* are rotated counterclockwise in FIG. 1, an image formation process is performed on each of the photosensitive drums 1*a* to 1*d*.

The transfer paper P, to which the toner images are secondarily transferred, is initially stored in a paper cassette 16 arranged in a lower part of the body of the image forming apparatus 100. From there, the transfer paper P is transferred, via a paper feed rolle 12*a* and a registration roller pair 12*b*, to the nip between the secondary transfer roller 9 and a driving roller 11 (described later) of the intermediary transfer belt 8. Used as the intermediary transfer belt 8 is a sheet of dielectric resin, and in particular one with no seam, that is, a seamless belt. On the downstream side of the secondary transfer roller 9, there is arranged a belt cleaner 19, in the shape of a blade, for removing toner and the like that remain on the surface of the intermediary transfer belt 8.

Next, the image formation sections Pa to Pd will be described. Around and under the rotatably arranged photosensitive drums 1*a* to 1*d*, there are arranged chargers 2*a*, 2*b*, 2*c*, and 2*d* for electrostatically charging the photosensitive drums 1*a* to 1*d*, an exposure device 5 for irradiating the photosensitive drums 1*a* to 1*d* with light carrying image information, developing devices 3*a*, 3*b*, 3*c*, and 3*d* for forming toner images on the photosensitive drums 1*a* to 1*d*, and cleaning units 7*a*, 7*b*, 7*c*, and 7*d* for removing developer (toner) and the like that remain on the photosensitive drums 1*a* to 1*d*.

On receipt of image data from a host device such as a personal computer, first, the chargers 2*a* to 2*d* electrostatically charge the surfaces of the photosensitive drums 1*a* to 1*d* uniformly, and then the exposure device 5 irradiates them with light carrying the image data, so that electrostatic latent images according to the image data are formed on the photosensitive drums 1*a* to 1*d*. The developing devices 3*a* to 3*d* are respectively loaded with predetermined amounts of two-component developer containing cyan, magenta, yellow, and black toner. With the progress of toner image formation (described later), when the proportion of toner in the two-component developer loaded in developing devices 3*a* to 3*d* falls below a prescribed value, toner is supplied from toner containers (supply units) 4*a* to 4*d* to the developing devices 3*a* to 3*d* respectively. The toner in the developer is fed from the developing devices 3*a* to 3*d* onto the photosensitive drums 1*a* to 1*d*, and electrostatically attaches to them, so that toner images according to the electrostatic latent images formed by exposure to light from the exposure device 5 are formed.

Then, transfer rollers 6*a* to 6*d* apply an electric field with a predetermined transfer voltage between the transfer rollers 6*a* to 6*d* and the photosensitive drums 1*a* to 1*d*, so that the cyan, magenta, yellow, and black toner images on the photosensitive drums 1*a* to 1*d* are primarily transferred to the intermediary transfer belt 8. These images of four colors are formed in a predetermined mutual positional relationship that is determined previously for the formation of a predetermined full-color image. Thereafter, in preparation for the subsequently performed formation of new electrostatic latent images, the toner and the like that have remained on the surfaces of the photosensitive drums 1*a* to 1*d* after primary transfer are removed by the cleaning units 7*a* to 7*d*.

The intermediary transfer belt 8 is wound around a driven roller 10 on the upstream side and a driving roller 11 on the downstream side with respect to the direction of transport of toner by the intermediary transfer belt 8. When the intermediary transfer belt 8 starts to rotate clockwise as the driving roller 11 rotates by being driven by a driving motor (unillustrated), transfer paper P is transported, with predetermined timing, from the registration roller pair 12*b* to the nip (secondary transfer nip) between the driving roller 11 and the secondary transfer roller 9, the latter being provided beside the former, so that the full-color image on the intermediary transfer belt 8 is secondarily transferred to the transfer paper P. The transfer paper P having the toner image secondarily transferred to it is transported on to the fusing section 13.

The transfer paper P transported to the fusing section 13 is subjected to heat and pressure by a fusing roller 13*a* so that the toner image is fused to the surface of the transfer paper P; thus, a predetermined full-color image is formed. The transfer paper P having the full-color image formed on it has its transport direction switched by a branching section 14 which branches into a plurality of directions. In a case where an image is formed only on one side of the transfer paper P, the transfer paper P is, as it is, discharged by a discharge roller pair 15 onto a discharge tray 17.

On the other hand, in a case where images are formed on both sides of transfer paper P, a part of the transfer paper P that has passed through the fusing section 13 is momentarily stuck out of the apparatus via the discharge roller pair 15. After the rear end of the transfer paper P has passed through the branching section 14, the discharge roller pair 15 is rotated in the reverse direction, and the transport direction of the branching section 14 is switched. As a result, the transfer paper P is directed, from its rear end, into a paper transport passage 18 so as to be transported once again, with the printed side reversed, to the secondary transfer nip. Then, the next toner image formed on the intermediary transfer belt 8 is secondarily transferred to the side of the transfer paper P on which no image has been formed yet. The transfer paper P having the toner image transferred to it is transported to the fusing section 13, where the toner image is fused, and then the transfer paper P is discharged onto the discharge tray 17.

Next, with reference to FIG. 2, the structure of the developing device 3*a* will be described in detail. FIG. 2 is a view from behind FIG. 1, and thus the arrangement of components inside the developing device 3*a* as shown in FIG. 2 is reversed right-side left compared with what is shown in FIG. 1. The following description focuses on the developing device 3*a* arranged in the image formation section Pa in FIG. 1, and no overlapping description will be repeated with respect to the developing devices 3*b* to 3*d* arranged in the image formation sections Pb to Pd, which have basically the same structure.

As shown in FIG. 2, the developing device 3*a* is provided with a developing container 20 formed of resin in which two-component developer (hereinafter referred to simply as the developer) is stored. The developing container 20 is divided into a stir-transport compartment 21 and a feed-transport compartment 22 by a partition wall 20*a*. In the stir-transport compartment 21 and the feed-transport compartment 22 respectively, there are rotatably arranged a stir-transport screw (a stir-transport member) 23*a* and a feed-transport screw (a stir-transport member) 23*b*, both for mixing and stirring toner (positively charged toner) fed from the toner container 4*a* (see FIG. 1) with carrier to electrostatically charge the toner. The stir-transport screw 23*a* transports developer toward one side along in the axial direction of a developing roller 31 (described later) (in the direction perpendicular to the plane of FIG. 2). The stir-transport screw 23*b*, while transporting developer in the opposite direction to the stir-transport screw 23*a*, feeds the developer to the developing roller 31.

In opposite end parts of the partition wall 20*a* (partitioning between the stir-transport compartment 21 and the feed-transport compartment 22) in its longitudinal direction (the direction perpendicular to the plane of FIG. 2), there are respectively provided communication openings (unillustrated) through which the stir-transport compartment 21 and the feed-transport compartment 22 communicate with each other in their end parts.

Developer is transported in the axial direction (the direction perpendicular to the plane of FIG. 2) while being stirred by the stir-transport screw 23*a* and the feed-transport screw 23*b*, and circulates between the stir-transport compartment 21 and the feed-transport compartment 22 through the communication openings formed in opposite end parts of the partition wall 20*a*. Thus, a developer circulation passage is formed through the stir-transport compartment 21, one communication opening, the feed-transport compartment 22, and another communication opening.

The developing container 20 extends in the upper right direction in FIG. 2, and over the feed-transport screw 23*b* inside the developing container 20, there is arranged a developing roller (developer carrier) 31. The developing roller 31 faces the photosensitive drum 1*a* on the open side (the right side in FIG. 2) of the developing container 20, and feeds toner to the photosensitive drum 1*a* in the region where these face each other. The developing roller 31 rotates counter-clockwise in the figure about its rotation axis.

In the stir-transport compartment 21, a toner concentration sensor (unillustrated) is arranged to face the stir-transport screw 23*a*, so that based on the result of detection by the toner concentration sensor, toner is supplied from the toner container 4*a* to the stir-transport compartment 21 through a toner supply port (unillustrated). Used as the toner concentration sensor is, for example, a magnetic permeability sensor that detects the magnetic permeability of the two-component developer containing toner and magnetic carrier present in the developing container 20.

The developing roller 31 is composed of a developing sleeve 31*a* which rotates counter-clockwise in FIG. 2, is cylindrical in shape, and is non-magnetic and a fixed magnet body 31*b* which is enclosed in the developing sleeve 31*a* and has a plurality of magnetic poles. In this embodiment, the magnetic poles of the fixed magnet body 31*b* are composed of an N pole as a regulating pole (ear-breaking pole) 42, an S pole as a transporting pole (unillustrated), an N pole as a main pole (unillustrated), an N pole as a peeling pole (unillustrated), etc.

The developing container 20 is fitted with an ear-breaking blade (restricting member) 32 along the longitudinal direction of the developing roller 31 (the direction perpendicular to the plane of FIG. 2). The ear-breaking blade 32 restricts the thickness of the developer carried on the developing roller 31. The ear-breaking blade 32 is located on the upstream side, with respect to the rotation direction of the developing roller 31 (the counter-clockwise direction in the figure), at a part thereof facing the ear-breaking blade 32, of the position at which the developing roller 31 and the photosensitive drum 1*a* face each other. Between a tip part of the ear breaking blade 32 and the surface of the developing roller 31, there is formed a narrow gap (clearance).

The ear-breaking blade 32 is held on a blade holding member 33. The blade holding member 33 is arranged on the upstream side of the ear-breaking blade 32 with respect to the rotation direction of the developing roller 31 (hereinafter referred to simply as the upstream side) at the part thereof facing the ear-breaking blade 32, and is fixed to a bottom part of the developing container 20. The blade holding member 33 may be omitted, in which case the ear-breaking blade 32 can be fixed directly to the developing container 20.

As shown in FIG. 3, the ear-breaking blade 32 is composed of a restricting base 50, which is formed of resin with higher strength than the resin of the developing container 20, and a metal foil 51, which is arranged at a top part of the restricting base 50. The restricting base 50 is formed of high-strength resin such as, for example, GFRP (glass-fiber reinforced plastic), is formed as a separate member from the developing container 20, and is formed with a thickness of about 1.5 mm.

The metal foil 51 is formed of, for example, austenitic stainless steel such as SUS304 or SUS301, ferritic stainless steel such as SUS430, copper, nickel, titanium, aluminum, or an alloy of any of those. The metal foil 51 is formed with a thickness of about 0.05 mm or more but 0.3 mm or less, and more preferably with a thickness of about 0.08 mm or more but 0.10 mm or less.

The metal foil 51 is bent in the shape of the letter "L," and thus has a downstream face portion 51*a*, which is fixed to the face 50*a* of the restricting base 50 on the downstream side with respect to the rotation direction of the developing roller 31 (hereinafter referred to simply as the downstream side), and a restricting face portion 51*b*, which is formed by bending the tip (a part on the developing roller 31 side) of the downstream face portion 51*a*.

The downstream face portion 51*a* is fixed to the restricting base 50 with a double-side adhesive material, a screw, or the like. The restricting face portion 51*b* is arranged to face the developing roller 31, and restricts the thickness of the developer carried on the developing roller 31. The restricting face portion 51*b* is kept in close contact with the face 50*b* of the restricting base 50 on the developing roller 31 side. The restricting face portion 51*b* is formed to protrude upstream beyond the restricting base 50.

The gap between the ear-breaking blade 32 and the developing roller 31 can be adjusted by adjusting the position at which the ear-breaking blade 32 is fitted to the blade holding member 33 (or the developing container 20).

To the developing roller 31 are applied a direct-current voltage (hereinafter referred to as Vslv(DC)) and an alternating-current voltage (hereinafter referred to as Vslv(AC). These direct- and alternating-current voltages are applied to the developing roller 31 from a developing bias power supply via a bias control circuit (neither is illustrated).

As mentioned earlier, developer circulates through the stir-transport compartment 21 and the feed-transport compartment 22 inside the developing container 20 while being stirred by the stir-transport screw 23*a* and the feed-transport screw 23*b*, and thereby the toner in the developer is electrostatically charged. The developer inside the feed-transport compartment 22 is transported to the developing roller 31 by the feed-transport screw 23*b*, and forms a magnetic brush (unillustrated) on the developing roller 31. The magnetic brush on the developing roller 31 then has its thickness restricted by the ear-breaking blade 32 and the regulating pole 42, and is then transported, by the rotation of the developing roller 31, to the position where the developing roller 31 and the photosensitive drum 1*a* face each other. Since Vslv(DC) and Vslv(AC) are applied to the developing roller 31, the potential difference from the photosensitive drum 1*a* causes toner to fly from the developing roller 31 to the photosensitive drum 1*a*, so that an electrostatic latent image is formed on the photosensitive drum 1*a*.

Thereafter, based on the result of detection by the toner concentration sensor (unillustrated), a predetermined amount of toner is supplied via the toner supply port (unillustrated), so that, while developer is circulating through the feed-transport compartment 22 and the stir-transport compartment 21, it is restored to a uniformly charged two-component developer with a predetermined toner concentration. This developer is fed once again to the developing roller 31 by the feed-transport screw 23*b* to form a magnetic brush on the developing roller 31, and is transported to the ear-breaking blade 32.

As described above, in this embodiment, the restricting base 50 of the ear-breaking blade 32 is formed of resin with a higher strength than the resin of the developing container 20. Thus, it is possible to give the ear-breaking blade 32 sufficient strength, and to suppress image degradation. Moreover, there is no need to change the resin material for the developing container 20 to give the restricting base 50 sufficient strength. Thus, it is possible to suppress an increase in cost. Moreover, the restricting base 50 is formed as a separate member from the developing container 20. Thus, it is possible to adjust the fitting position of the restricting base 50 on the developing container 20, and to facilitate the adjustment of the gap between the developing roller 31 and the ear-breaking blade 32.

Moreover, at a tip part of the restricting base 50, the metal foil 51 is provided. This, as compared with forming the ear-breaking blade 32 out of resin alone, helps form the tip part of the ear-breaking blade 32 with higher accuracy, and helps greatly suppress wear of the tip part of the ear-breaking blade 32. Thus, it is possible to obtain high image quality.

Moreover, the metal foil 51 has the downstream face portion 51*a*, which is fixed to the downstream-side face 50*a* of the restricting base 50. Thus, it is easy to fix the metal foil 51, at its downstream face portion 51*a*, to the restricting base 50. Moreover, the metal foil 51 has the restricting face portion 51*b*, which is formed by bending the tip of the downstream face portion 51*a* to the upstream side. Thus, it is easy to form a restricting face portion 51*b* that is flat from the tip part toward the upstream-side end of the downstream face portion 51*a*, and thus it is easy to restrict the thickness of developer stably.

Moreover, as described above, the restricting face portion 51*b* protrudes upstream beyond the restricting base 50. This makes it less likely for the developer transported by the feed-transport screw 23*b* to stagnate near the upstream-side end of the region where the developing roller 31 and the ear-breaking blade 32 face each other. It is thus possible to reduce stress on developer, and thus to obtain a higher image quality. Incidentally, stagnant developer is subject to stress. Specifically, particles of developer rub against one another, causing external additive to sink in toner particles, or causing external additive to move from toner to carrier and thereby degrading toner and carrier. This results in degraded image quality.

Moreover, as described above, the metal foil 51 is formed with a thickness of about 0.05 mm or more, and more preferably with a thickness of about 0.08 mm or more. Thus, it is easy to give the metal foil 51 sufficient strength. Moreover, the metal foil 51 is formed with a thickness of about 0.3 mm or less, and more preferably with a thickness of about 0.1 mm or less. Thus, it is possible to suppress development of a crack at the part of the metal foil 51 where it is bent (the boundary between the downstream face portion 51*a* and the restricting face portion 51*b*). Incidentally, the thicker the metal foil 51, the more likely a crack develops at the bent part, and thus the more likely developer lodges in the crack, leading to degraded image quality. Moreover, forming the metal foil 51 with a thickness of 0.3 mm or less helps suppress an increase in the weight of the ear-breaking blade 32.

(Second Embodiment)

Figure 4:
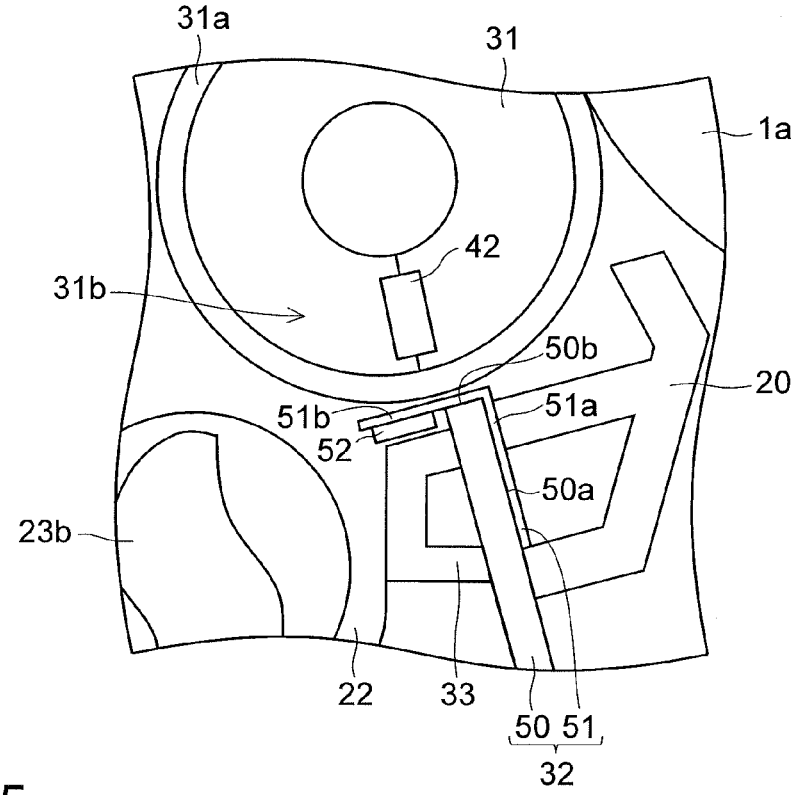
FIG. 4 is an enlarged sectional view showing the structure of and around an ear-breaking blade in a developing device according to a second embodiment of the present disclosure.

In a developing device 3*a* according to a second embodiment of the present disclosure, as shown in FIG. 4, the ear-breaking blade 32 includes a magnetic member 52 which is formed of magnetic sheet metal and which is arranged beneath the restricting face portion 51*b* of the metal foil 51 (on the side opposite from the developing roller 31). The magnetic member 52 is arranged beneath the part of the restricting face portion 51*b* protruding upstream beyond the restricting base 50. The magnetic member 52 may instead be arranged between the restricting face portion 51*b* and the tip (face 50*b*) of the restricting base 50. The magnetic member 52 may be fixed to the metal foil 51, or may be fixed to the blade holding member 33 or the restricting base 50. In place of the magnetic member 52, a magnet may be arranged.

Otherwise, the structure according to the second embodiment is similar to that according to the first embodiment described previously.

In this embodiment, as described above, beneath the restricting face portion 51*b*, the magnetic member 52 or a magnet is provided. Thus, it is possible to strengthen the magnetic field produced between the regulating pole 42 inside the developing roller 31 and the restricting face portion 51*b* of the metal foil 51, and to enhance the restricting power acting on the developer on the surface of the developing roller 31; thus, it is possible to form the magnetic brush more stably.

Otherwise, the effect of the second embodiment is similar to that of the first embodiment described previously.

(Third Embodiment)

Figure 5:
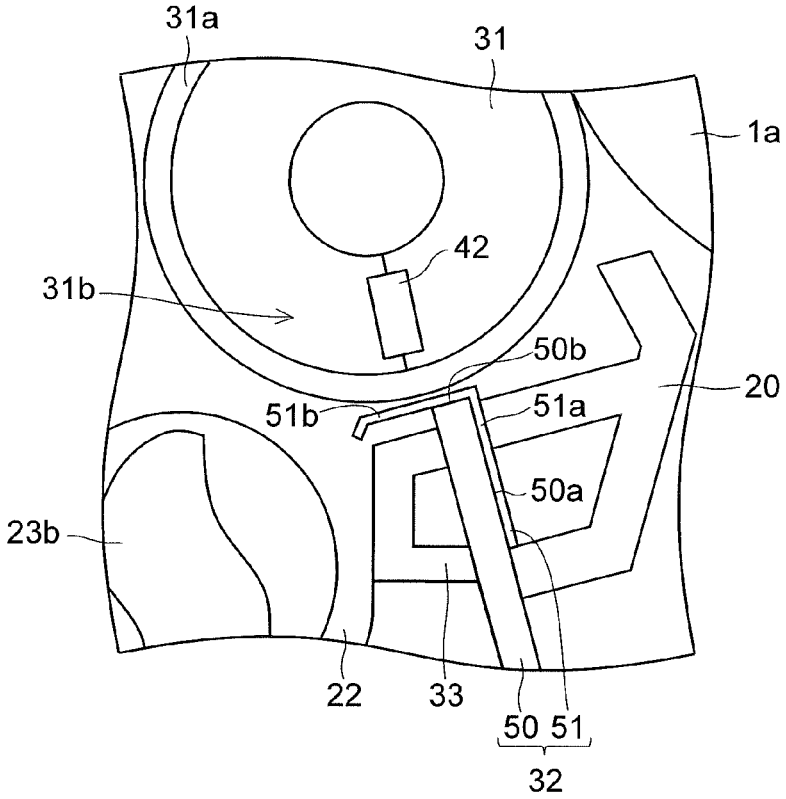
FIG. 5 is an enlarged sectional view showing the structure of and around an ear-breaking blade in a developing device according to a third embodiment of the present disclosure.

In a developing device 3*a* according to a third embodiment of the present disclosure, as shown in FIG. 5, an upstream-side end part of the restricting face portion 51*b* of the metal foil 51 is bent downward (in the direction away from the developing roller 31).

Otherwise, the structure according to the third embodiment is similar to that according to the first embodiment described previously.

In this embodiment, as described above, an upstream-side end part of the restricting face portion 51*b* is bent. Thus, it is possible to further increase the strength of the restricting face portion 51*b*, and thus to suppress fluttering of the restricting face portion 51*b* and further suppress a lowering in image quality. Moreover, the upstream-side end part of the restricting face portion 51*b* (the entrance for developer) can be formed stably, and thus it is possible to further suppress a lowering in image quality.

Otherwise, the effect of the third embodiment is similar to that of the first embodiment described previously.

(Fourth Embodiment)

Figure 6:
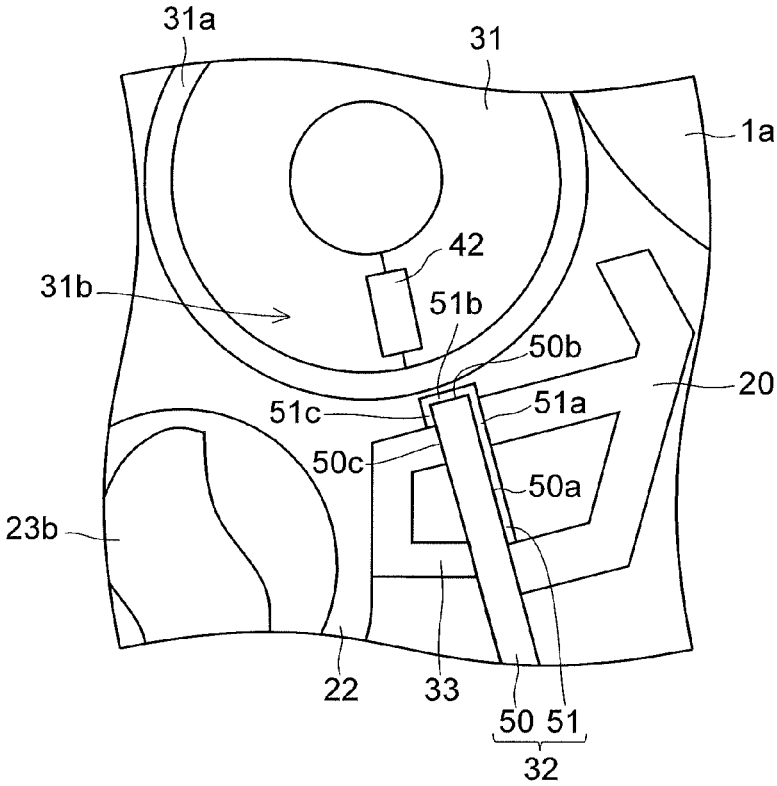
FIG. 6 is an enlarged sectional view showing the structure of and around an ear-breaking blade in a developing device according to a fourth embodiment of the present disclosure.

In a developing device 3*a* according to a fourth embodiment of the present disclosure, as shown in FIG. 6, the metal foil 51 is formed by bending an upstream-side part of the restricting face portion 51*b* downward (in the direction opposite from the developing roller 31), and thus has an upstream face portion 51*c* which is fixed to the upstream-side face 50*c* of the restricting base 50. The metal foil 51 is fixed as a result of it holding, between its upstream- and downstream face portions 51*c* and 51*a*, the restricting base 50.

Otherwise, the structure according to the fourth embodiment is similar to that according to the first embodiment described previously.

In this embodiment, as described above, the metal foil 51 has the upstream face portion 51*c* which is formed by bending an upstream-side part of the restricting face portion 51*b* and is fixed to the upstream-side face 50*c* of the restricting base 50. Thus, it is possible to fix the metal foil 51 by letting it hold, between its upstream- and downstream face portions 51*c* and 51*a*, the restricting base 50. Thus, it is possible to fix the restricting face portion 51*b* more stably. This helps obtain higher image quality.

Otherwise, the effect of the fourth embodiment is similar to that of the first embodiment described previously.

(Fifth Embodiment)

Figure 7:
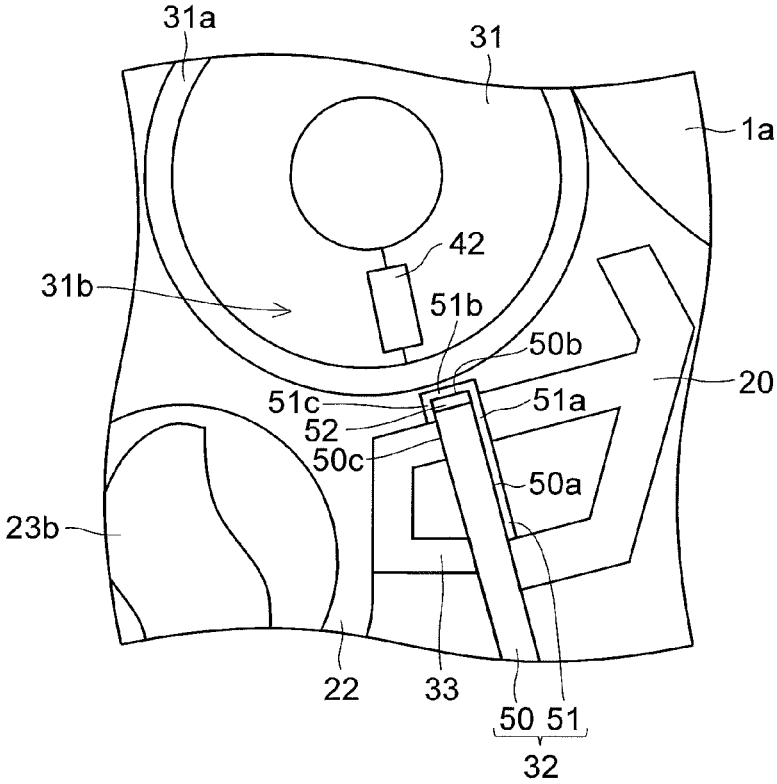
FIG. 7 is an enlarged sectional view showing the structure of and around an ear-breaking blade in a developing device according to a fifth embodiment of the present disclosure.

In a developing device 3*a* according to a fifth embodiment of the present disclosure, as shown in FIG. 7, the ear-breaking blade 32 includes the magnetic member 52 which is formed of magnetic sheet metal or the like and which is arranged under (on the side opposite from the developing roller 31) the restricting face portion 51*b* of the metal foil 51. The magnetic member 52 is arranged between the restricting face portion 51*b* and the restricting base 50. In place of the magnetic member 52, such as a magnetic or magnetized sheet metal, a magnet (e.g. intrinsic magnet) may be arranged.

Otherwise, the structure according to the fifth embodiment is similar to that according to the fourth embodiment described previously.

In this embodiment, as described above, under the restricting face portion 51*b*, the magnetic member 52 or a magnet is provided. Thus, it is possible to strengthen the magnetic field produced between the regulating pole 42 inside the developing roller 31 and the restricting face portion 51*b* of the metal foil 51, and to enhance the restricting power acting on the developer on the surface of the developing roller 31; thus, it is possible to form the magnetic brush more stably.

Otherwise, the effect of the fifth embodiment is similar to that of the fourth embodiment described previously.

(Sixth Embodiment)

Figure 8:
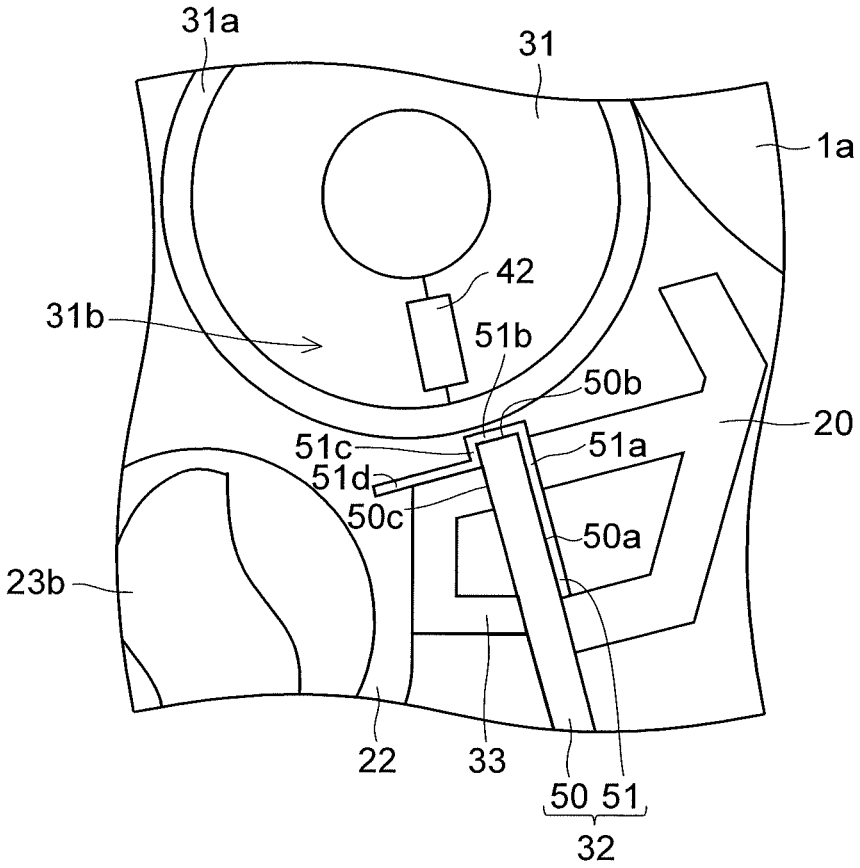
FIG. 8 is an enlarged sectional view showing the structure of and around an ear-breaking blade in a developing device according to a sixth embodiment of the present disclosure.

In a developing device 3*a* according to a sixth embodiment of the present disclosure, as shown in FIG. 8, the metal foil 51 has a stagnation suppressing face portion 51*d* formed by bending to the upstream side a lower part (a part on the side opposite from the developing roller 31) of the upstream face portion 51*c*. The stagnation suppressing face portion 51*d* is formed to extend upstream from the restricting base 50, and suppresses stagnation of developer near the upstream-side end of the region where the developing roller 31 and the ear-breaking blade 32 face each other.

Otherwise, the structure according to the sixth embodiment is similar to that according to the fourth embodiment described previously.

In this embodiment, as described above, the metal foil 51 has the stagnation suppressing face portion 51*d* which is formed by bending to the upstream side a lower part of the upstream face portion 51*c*. Thus, it is possible to suppress stagnation of the developer transported by the feed-transport screw 23*b* near the upstream-side end of the region where the developing roller 31 and the ear-breaking blade 32 face each other. Thus, it is possible to suppress stress on developer, and thus to obtain high image quality. Incidentally, stagnant developer is subject to stress. Specifically, particles of developer rub against one another, causing external additive to sink in toner particles, or causing external additive to move from toner to carrier and thereby degrading toner and carrier. This results in degraded image quality.

Otherwise, the effect of the sixth embodiment is similar to that of the fourth embodiment described previously.

It should be understood that the embodiments disclosed herein are in every respect illustrative and not restrictive. The scope of the present disclosure is defined not by the description of the embodiment given above but by the appended claims, and encompasses any modifications and variations made in the sense and scope equivalent to those of the claims.

For example, although examples have been dealt with where the present disclosure is applied to a tandem-type color image forming apparatus as shown in FIG. 1, this is not meant to limit the application of the present disclosure. Needless to say, the present disclosure finds applications in a variety of image forming apparatuses incorporating a developing device provided with a restricting member for restricting the layer thickness of developer on the surface of a developer carrier, examples of such image forming apparatuses including monochrome copiers, monochrome printers, digital multifunction peripherals, and facsimile machines.

Although the embodiments described above deal with examples where a developing roller is provided as a developer carrier, this is not meant to limit the implementation of the present disclosure. Between the stir-transport member and the developing roller, a magnetic roller may be provided as a developer carrier.

Although the second and fifth embodiments described above deal with examples where, to enhance the restricting power acting on the developer on the surface of the developing roller 31, the magnetic member 52 or a magnet is provided under the restricting face portion 51*b*, this is not meant to limit the implementation of the present disclosure. To enhance the restricting power acting on the developer on the surface of the developing roller 31, the restricting face portion 51*b* may be formed of a magnetic material.

It should be understood that the technical scope of the present disclosure encompasses any structures obtained by appropriately combining together features from different embodiments and modified examples described hereinabove.

What is claimed is:

1. A developing device, comprising:

a developing container in which developer containing carrier and toner is stored;

a stir-transport member which stirs and transports the developer inside the developing container;

a developer carrier which carries the developer fed from the stir-transport member; and a restricting member arranged to face the developer carrier and which restricts layer thickness of the developer on a surface of the developer carrier, wherein the restricting member includes:

a restricting base formed of resin, and a metal foil arranged at a tip part of the restricting base, and the metal foil includes:

a downstream face portion which is fixed to a downstream-side face of the restricting base with respect to a rotation direction of the developer carrier at a part thereof facing the restricting member, a restricting face portion which is formed by bending a tip of the downstream face portion to an upstream side with respect to the rotation direction of the developer carrier at a part thereof facing the restricting member and which is arranged to face the developer carrier, an upstream face portion which is formed by bending, away from the developer carrier, an upstream-side part of the restricting face portion with respect to the rotation direction of the developer carrier at the part thereof facing the restricting member, a part of the upstream face portion being fixed to an upstream-side face of the restricting base with respect to the rotation direction of the developer carrier at the part thereof facing the restricting member, and a stagnation suppressing face portion which is formed by bending, to an upstream side with respect to the rotation direction of the developer carrier at the part thereof facing the restricting member, a part of the upstream face portion on a side thereof opposite from the developer carrier and which suppresses stagnation of the developer.

2. The developing device according to claim 1, further comprising a magnetic member or a magnet arranged between the restricting face portion and the restricting base.

3. The developing device according to claim 1, wherein the metal foil is formed with a thickness of 0.05 mm or more but 0.3 mm or less.

4. The developing device according to claim 3, wherein the metal foil is formed with a thickness of 0.08 mm or more but 0.1 mm or less.

5. An image forming apparatus, comprising the developing device according to claim 1.

* * * * *